US005823531A

United States Patent [19]

Huber

[11] Patent Number: 5,823,531

[45] Date of Patent: Oct. 20, 1998

[54] THREE-DIMENSIONAL PUZZLE ASSEMBLED FROM SEPARATE PIECES

[75] Inventor: Christian Huber, 1 rue de la Verdure, 67640 Fegersheim, France

[73] Assignees: Christian Huber, Fegersheim; Olivier Lamat, Illkirch Graffenstaden, both of France

[21] Appl. No.: 666,891

[22] Filed: Jun. 14, 1996

[30] Foreign Application Priority Data

Jun. 14, 1995 [FR] France ..... 95 07259

[51] Int. Cl.[6] ..... A63F 9/08

[52] U.S. Cl. ..... 273/156; 446/116

[58] Field of Search ..... 273/153 R, 157 R, 273/159, 160, 156; 446/116, 108, 111, 112, 115, 120, 121, 122

[56] References Cited

U.S. PATENT DOCUMENTS

| | | | |
|---|---|---|---|
| 2,119,921 | 6/1938 | Levy | 446/116 |
| 2,958,918 | 11/1960 | MacMillan | 273/157 R |
| 4,083,123 | 4/1978 | Livermore | 273/157 R |
| 4,345,762 | 8/1982 | Lebelson | 273/160 |
| 4,509,930 | 4/1985 | Schweigert et al. | 446/116 |
| 4,685,892 | 8/1987 | Gould et al. | 446/116 |
| 5,222,902 | 6/1993 | Piersch | 446/116 |

*Primary Examiner*—Steven B. Wong
*Attorney, Agent, or Firm*—Davis and Bujold

[57] ABSTRACT

A three-dimensional puzzle assembled from puzzle pieces having a succession of rectilinear, curved, or rectilinear and curved segments that cooperate with other assembling and immobilization means used to assemble the puzzle. The assembling and the immobilization means are disposed upon each segment and comprise a contact edge with a flat portion that contacts the flat portion of an adjacent puzzle piece when assembled, at least one lateral extension which forms an overlapping shoulder with the contact edge and a connecting tab located at the extremity of the lateral extension that snaps into a receptor opening of an adjacent puzzle piece when assembled.

12 Claims, 5 Drawing Sheets

THREE-DIMENSIONAL PUZZLE ASSEMBLED FROM SEPARATE PIECES

REALM OF THE INVENTION

The present invention relates to a puzzle made of separate elements which form a three-dimensional object when assembled.

TECHNOLOGICAL BACKGROUND OF THE INVENTION

Puzzles know in the art, which are assembled flat, have pieces which stay attached because they are immobilized. This is possible because the pieces are shaped with protruding strips or handles which mesh with complementary shapes, such as inwardly or outwardly curved elements.

Immobilizing the puzzles pieces by interlocking them in this way is usually sufficient to keep the puzzle assembled when in a flat, horizontal position. However, if one wishes to display the completed puzzle vertically like a picture, the puzzle pieces usually must be glued one at a time to a suitable background support, as the pieces will not remain attached to each other. This is a long, tedious procedure which is also irreversible, as the puzzle cannot be taken apart and put together again.

Such a puzzle may also be displayed in a suitable frame.

A puzzle forming a three-dimensional object is altogether different, as the puzzle pieces must be supported by an immobilizing structure at several points without using any adhesive agent, and they must form a framework that not only keeps the assembled elements attached wherever the object is placed, but resists repeated handling.

In general, there is need for a simple, dependable and quick system so puzzles can be enjoyed like a game, and assembled and dismantled at will.

OBJECTS OF THE INVENTION

The goal of the present invention is to meet these and other needs by proposing a three-dimensional object which is assembled like a puzzle, that is, by juxtaposing and linking separate elements.

SUMMARY OF THE INVENTION

The puzzle according to the invention can be assembled simply, rapidly, reliably, and efficiently. Furthermore, the puzzle pieces can be economically mass-produced from injection molded plastic.

To economize on material, the component pieces can be thin but still grip well, with a hollow interior that does not detract from appearance, since it is invisible from the outside.

Assembling and re-assembling the object should be simple enough to be considered play and should present no particular difficulty.

The puzzles can represent a wide variety of objects, such as animate or inanimate public domain symbols, or models of man-made objects.

The puzzle components may be molded all in one color or in different colors, so the range of color contrasts and shadings improves the appearance of the completed object. It is also possible to reproduce an elementary symbol, such as a geometric shape or the like, on the visible surface of some or all of the components, so the symbol becomes recognizable during the final stage of assembling the object.

Thus, the advantage of the present invention is that it proposes a novel three-dimensional object which can be simply and enjoyably reassembled at will like a puzzle, by juxtaposing and assembling its separate elements.

According to another advantage, the object thus assembled is durable and can be manipulated, moved, or displayed after assembly with no difficulty. It is quick, easy and reliable to either assemble or disassemble.

The three-dimensional object according to the invention can have various forms, such as simple geometric shapes (spheres, cylinders, cubes, or the like), or more complex shapes (bottles, containers, books, or models of cars, monuments, houses, etc.).

BRIEF DESCRIPTION OF THE DRAWINGS

Other characteristics and advantages of the invention will be apparent from the following description, offered as a non-limiting example of a preferred embodiment, and with reference to the accompanying drawings, wherein.

DETAILED DESCRIPTION OF THE EMBODIMENTS SHOWN

The basis of the invention is connecting puzzle pieces whose outer surfaces comprise a three-dimensional object and assembling the puzzle using lateral extensions which each have an immobilizing means cooperating with a recognizable complementary shape on another adjacent element.

Figure 1:
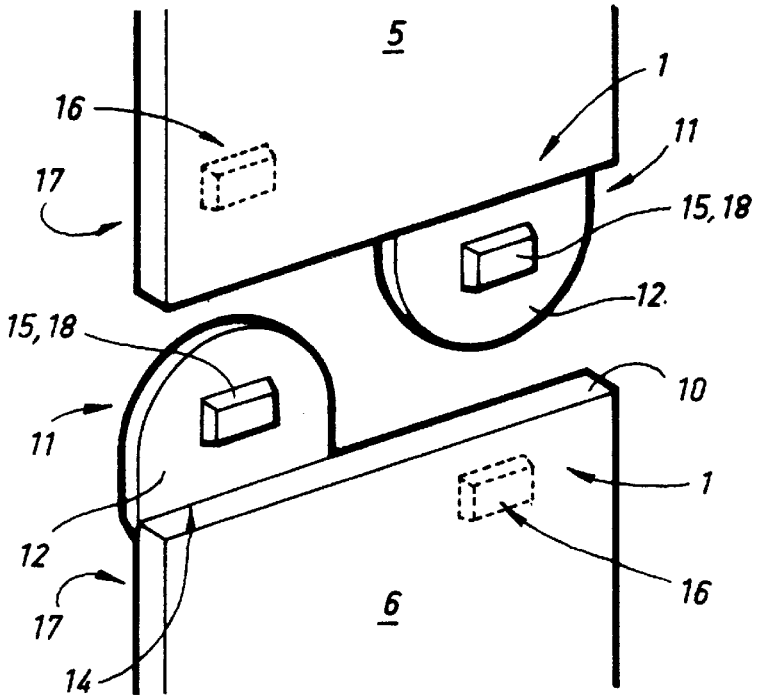
FIG. 1 is a schematic perspective view of a first method of assembling two simple puzzle elements.
Figure 2:
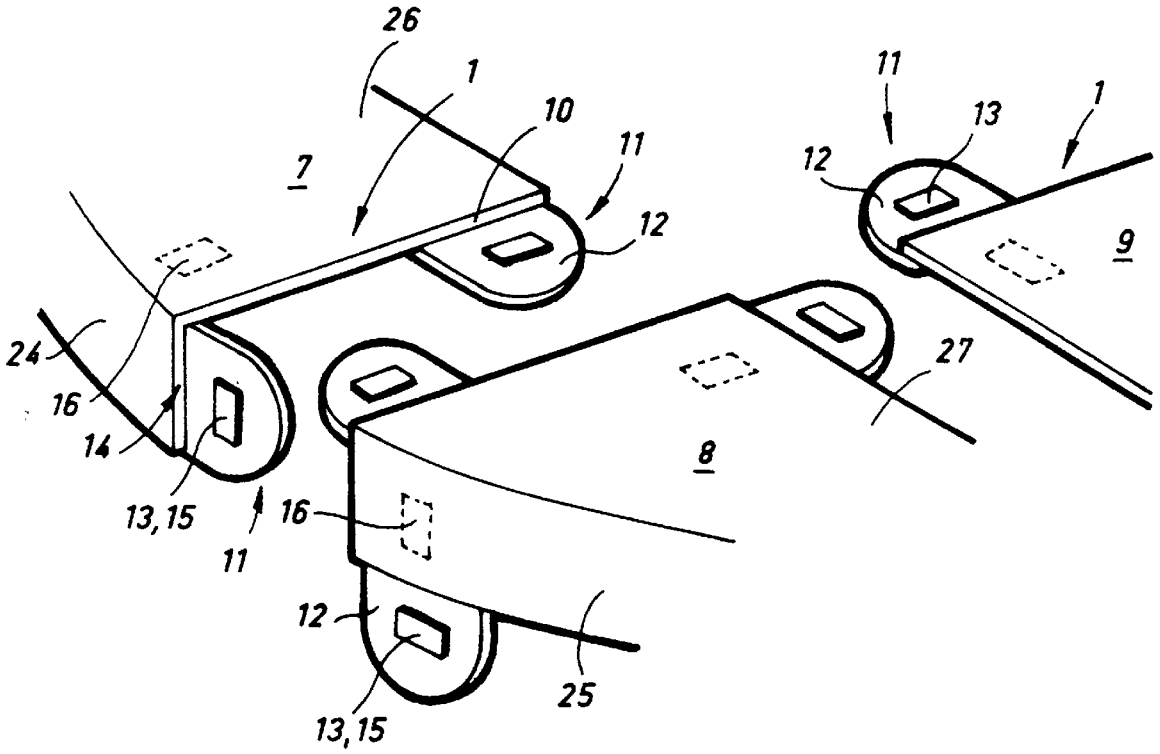
FIG. 2 is a schematic view of a second method of assembling pieces with extensions that have both straight and curved contours.
Figure 3:
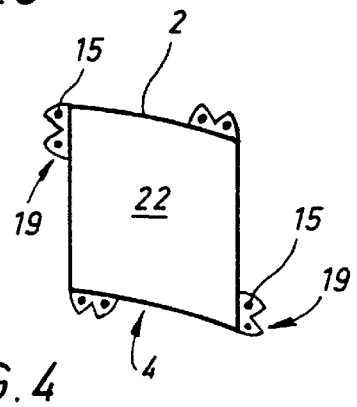
FIG. 3 is a schematic view of a puzzle piece with double connectors.

The basic method of assembly shown in FIGS. 1 through 3 is as follows. At least one rectilinear edge, with either a straight segment 1, or a curved segment 2, or a segment which is partly straight and partly curved 3, on the perimeter 4 of one of the puzzle elements 5 and 6 (FIG. 1), or 7, 8, 9 (FIG. 2), has a flat edge 10 and, on at least one extremity, there is a lateral extension 11, preferably recessed, constituting a connecting tab 12, comprising an immobilization means 13, and which is maintained in place by elasticity, by pressure, or by snapping it in place. The flat portion 10 of contact edge 1, 2, or 3 and lateral extension 11 form an overlapping shoulder 14 which cooperates with fastener 12 to assemble the juxtaposed elements.

The assembly is strengthened by immobilization means 13, which may work by applying pressure, and which is found on the free extremity of each connector 12. The immobilization means may be of the type shown, that is, it may be a transverse protuberance 15, cooperating with a complementary receptor shape 16, which is located opposite it on adjacent piece 5 or 6 on the back surface 17. The shape of protuberance 15 can range from a faceted shape 18 to a snap slightly flattened at one end (not shown).

Connector 12 can be doubled to strengthen its hold, as seen in double connector 19 shown in FIG. 3. It has the same basic elements.

Figure 4:
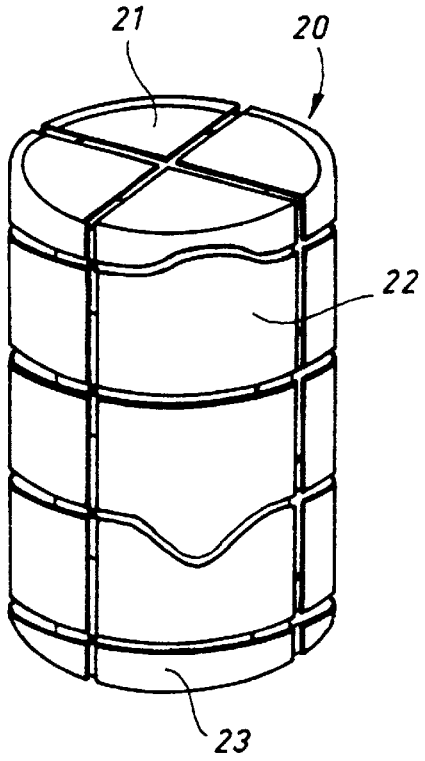
FIGS. 4 and 5 are perspective views of a cylinder, shown both assembled and disassembled, respectively, using a first shape of puzzle pieces.
Figure 5:
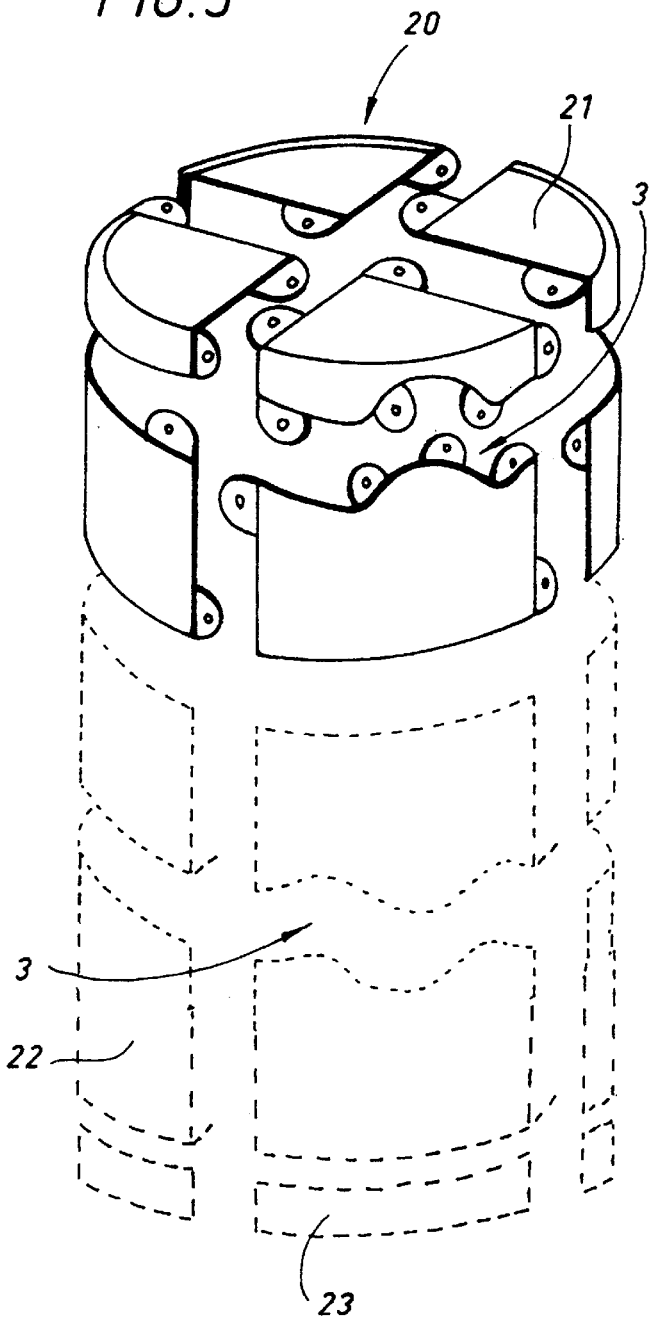

A first preferred embodiment is described below with particular reference to FIGS. 4 and 5, which show a cylinder 20 with a hollow interior, previously broken down into puzzle elements 21, 22, 23, forming the simple geometric shapes of the top, the lateral surface, and the bottom of the cylinder, respectively, and preferably consisting of a succession of straight segments 1 or mixed segments 3, with an alternating pattern of segments with straight and curved portions.

Pieces 21 through 23 are interconnected using the basic assembly elements shown in FIGS. 1 through 3, described above.

Figure 6:
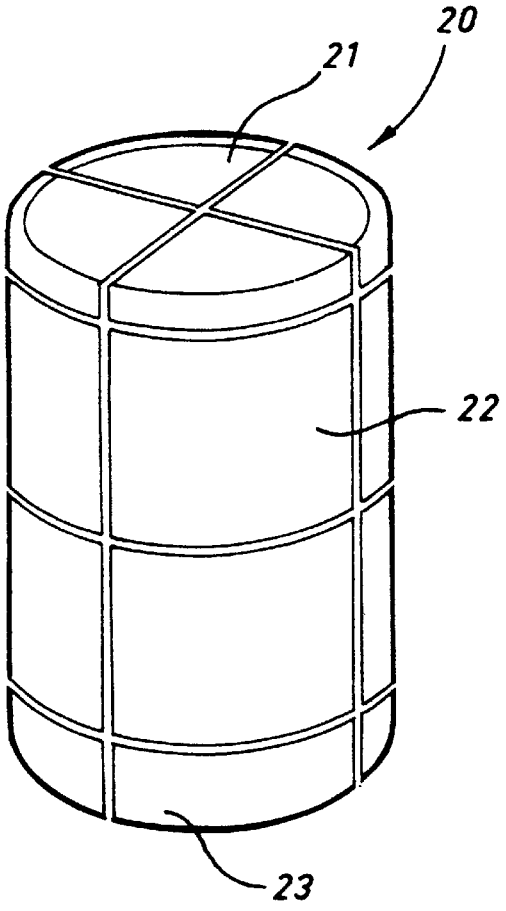
FIGS. 6 and 7 are perspective views of a cylinder, shown both assembled and disassembled, using a second shape of puzzle pieces.
Figure 7:
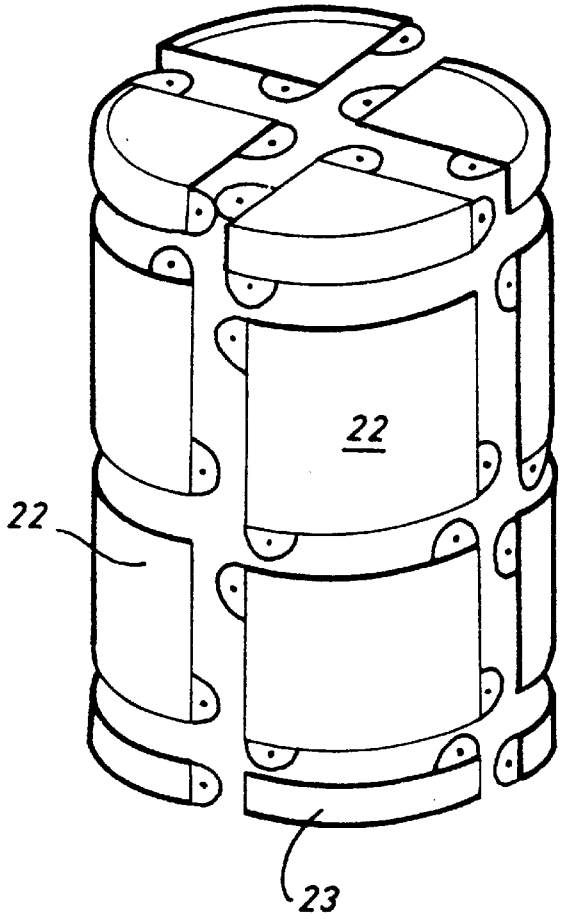
Figure 8:
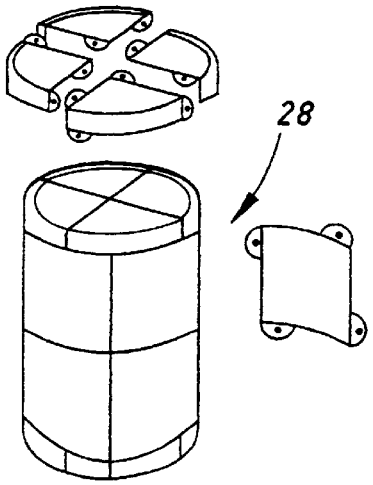
FIGS. 8 through 17 are schematic views of various objects, respectively: a box, a bottle, a container, a pot, a carton, a book, a food item, a car, an animal, in which some of the drawings show the puzzle components.
Figure 9:
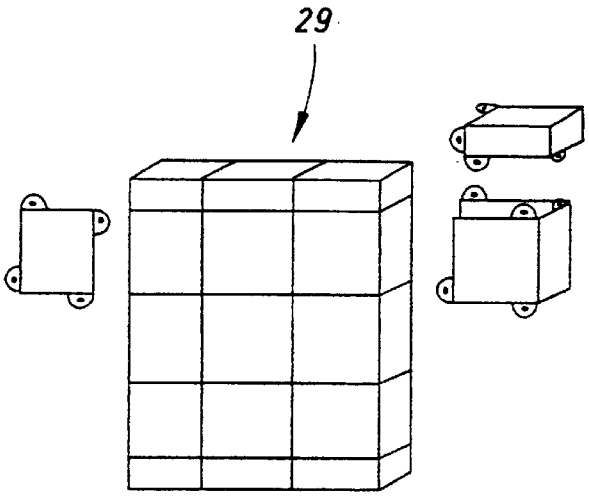
Figure 10:
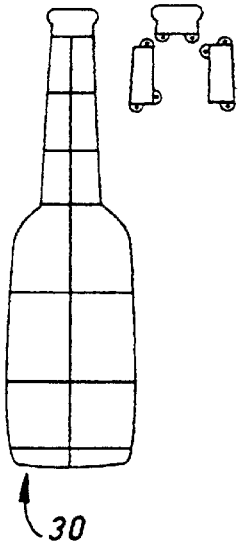
Figure 11:
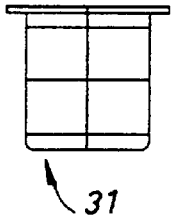
Figure 12:
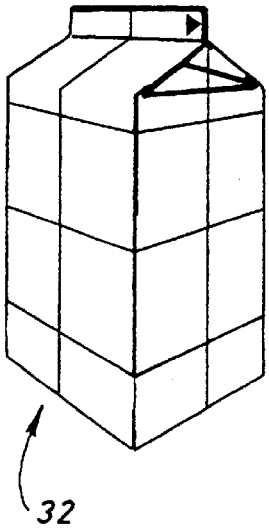
Figure 13:
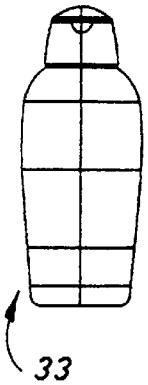
Figure 14:
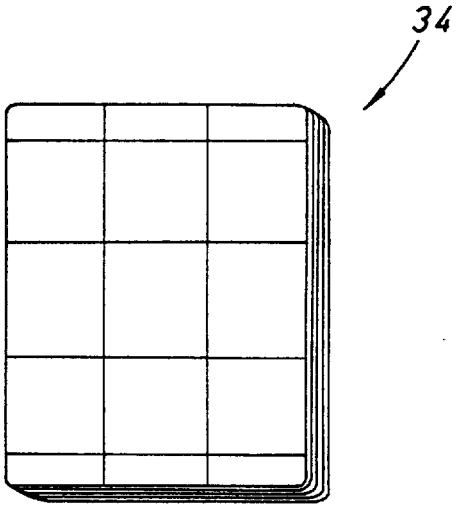
Figure 15:
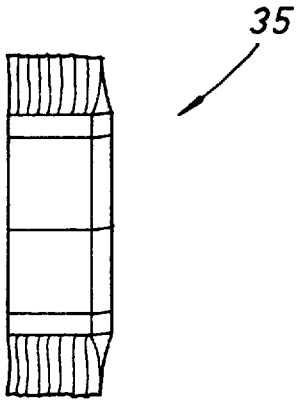

Obviously, the elements constituting hollow cylinder 20 could have contours formed simply of straight segments 1 or of curved segments 2 as shown in FIGS. 6 and 7.

As shown, each puzzle element has at least one connector 12 on the same side, in the form of a lateral extension on each edge.

Each connecting tab 12 has an immobilizing protruding element 15, which is preferably transverse and may be shaped like a snap, a pellet, a faceted block 18, or whatever other shape can be pressed or snapped into complementary shape 16, which may be a receptor opening formed in the immediately adjacent puzzle piece.

In the basic exemplary embodiment shown as in FIG. 1, the immobilizing protruding element on the connector is a faceted block 18, which cooperates with a receptor opening 16 of complementary shape on the back surface 17 of the adjacent puzzle element.

Obviously, the shapes of immobilizing connecting tabs 15 and complementary receptors 16 can be reversed.

An essential advantage of the invention is that the complementary immobilizing elements 15 and the receptor elements 16 are shaped so that after one connector 12 of a puzzle piece has been placed on the back surface 17 of an adjacent piece, and after corresponding complementary shapes 15 and 16 are snapped or pressed into place, the straight or curved opposing surfaces of the two puzzle pieces to be assembled are overlapped, maintaining them firmly in place and forming a tightly constructed assembled object.

To facilitate overlapping between the pieces, connector 12 may be recessed, to conform with the corresponding flat shape of edges 1, 2, or 3 of a puzzle piece and the connecting base of connector 12 on said piece, overlapping shoulder 14.

Overlapping shoulder 14 can be located anywhere on corresponding edges 1, 2, or 3 of the puzzle piece, and preferably along the entire length thereof.

According to the basic embodiment shown in FIGS. 1, 2, and 3, either a single or double connector, 12 and 19, respectively, is provided on at least one extremity of each straight segment 1 or near at least one extremity of each curved segment of the puzzle pieces.

This configuration is advantageous because it improves the extent to which the puzzle pieces support each other and fit together, thus keeping them in place.

According to an improved embodiment of the puzzle, with reference to FIG. 2, puzzle pieces 6, 7, and 8 have extensions 24 and 25 which may be perpendicular to the exterior surface panels 26, 27 of these pieces.

There are connectors 12 in both the lateral extensions of elements 24, 25 and of the exterior surface panels 26, 27 of the puzzle pieces, located either on some portion of the edges of the pieces or at each extremity.

Such adjacent puzzle pieces are connected in two distinct planes, one of which is the perpendicular plane, preventing any relative movement between the pieces. This ensures cohesiveness between the elements comprising the assembled object.

Figure 16:
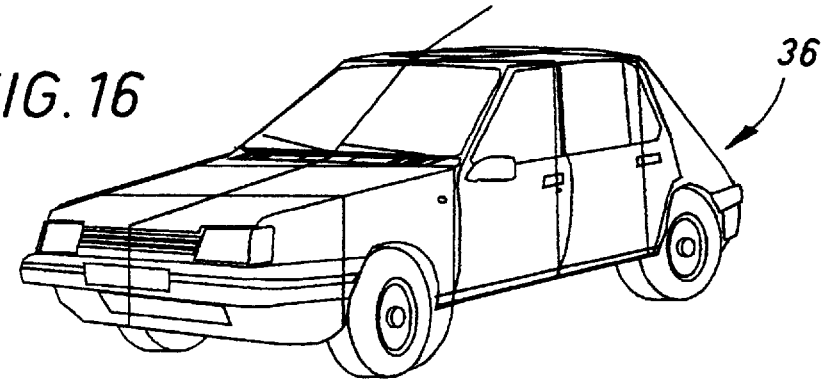
Figure 17:
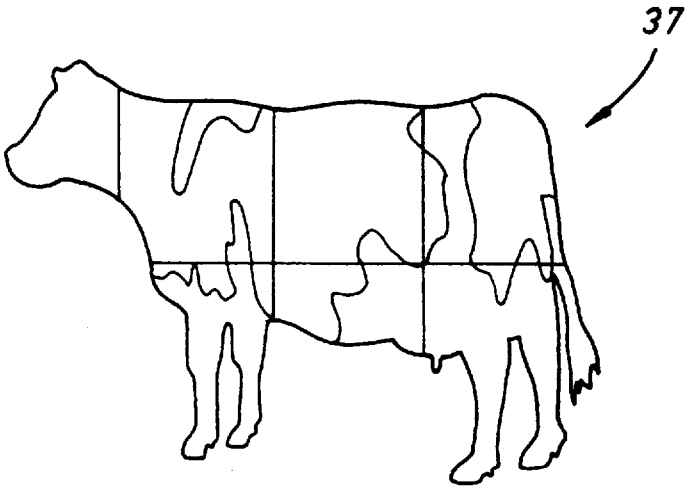

To better illustrate the scope of the present invention, FIGS. 8 through 17 show several constructed objects, namely, a hollow cylinder 28 (FIG. 8), a box 29 (FIG. 9), a bottle 30 (FIG. 10), a pot 31 (FIG. 11), a carton 32 (FIG. 12), a container 33 (FIG. 13), a book 34 (FIG. 14), a food item 35 (FIG. 15), a car 36 (FIG. 16, and an animal 37 (FIG. 17).

These are hollow objects with a plastic covering or shell. The shell is broken down into several elementary pieces which are assembled using the cooperating overlapping shoulders/edges, the connectors, and the immobilization structures described above to reconstruct the original shape.

Naturally, when the object is divided up into individual elements, simple geometric shapes are selected. Thus, complex three-dimensional shapes will be formed of one piece whenever possible or, at best, split up into simple geometric shapes.

I claim:

1. A three-dimensional object being formed from a plurality of separately interconnected pieces, each of said plurality of separate interconnected pieces comprising:

a main element having a first surface and an opposed second surface and a plurality of side surfaces;

said second surface having at least one lateral extension being offset with respect to and extending from said second surface of said main element along each of said plurality of side surfaces, each said lateral extension only extending a Partial distance along a length of said side surface, and said at least one lateral extension supporting a protuberance thereon;

said second surface also having at least one recess formed therein alone each of said side surfaces, said at least one recess being spaced from said at least one lateral extension and extending only partially from said second surface toward said first surface, and said at least one recess being shaped so as to releasably mate with and lock a protuberance of another interconnectable piece; and said at least one lateral extension being rigidly supported by said main element.

2. The three dimensional object according to claim 1, wherein said plurality of side surfaces, of said main element, extend substantially perpendicular to edge portions of both said first and said second surfaces to facilitate abutment between adjacent side surfaces of two interconnected pieces whereby said first surfaces of said two interconnected pieces, upon interlocking of said two interconnected pieces to one another, form a substantial continuous, smooth and uninterrupted first surface and said abutted side surfaces always extend parallel to one another.

3. The three dimensional object according to claim 1, wherein a supporting surface of said lateral extension, which supports said at least one protuberance, is coplanar with at least the adjacent edge portion of said second surface and said at least one protuberance extends substantially perpendicular to said supporting surface of said lateral extension.

4. The three dimensional object according to claim 1, wherein said at least one protuberance is a faceted block.

5. The three dimensional object according to claim 1, wherein at least one of said lateral extensions has two protuberances disposed thereon and a matable interconnectable piece has two mating recesses located in said second surface to receive said two protuberances of said lateral extension.

6. The three dimensional object according to claim 1, wherein said at least one protuberance is flattened, at a remote end thereof, and said recess has a mating flattened area to facilitate receiving said at least one flattened protuberance.

7. The three dimensional object according to claim 1, wherein said at least one lateral extension is void of any hinge.

8. A three-dimensional object being formed from a plurality of separately interconnected pieces, each of said plurality of separate interconnected pieces comprising:

a main element having a first surface and an opposed second surface and a plurality of side surfaces;

said second surface having at least one lateral extension being offset with respect to and extending from said second surface of said main element along each of said plurality of side surfaces, each said lateral extension only extending a partial distance along a length of said side surface, and each said at least one lateral extension supporting one of at least one protuberance and at least one recess on a supporting surface thereof which is coplanar with at least the adjacent edge portion of said second surface;

said second surface also supporting the other of at least one protuberance and at least one recess thereon, alone each of said side surfaces, at a location spaced from said at least one lateral extension, said at least one recess extending only partially through said surface and being shaped so as to releasibly mate with and lock a protuberance of another interconnectable piece; and said at least one lateral extension being rigidly attached to said main element to prevent pivoting between said main element and said at least one lateral extension.

9. The three dimensional object according to claim 8, wherein said plurality of side surfaces, of said main element, extend substantially perpendicular to edge portions of both said first surface and said second surfaces to facilitate abutment of two adjacent interconnected pieces whereby said first surfaces of said two interconnected pieces, upon interlocking of said two interconnected pieces with one another, form a substantial continuous, smooth and uninterrupted first surface and said abutting side surfaces always extend parallel to one another.

10. The three dimensional object according to claim 9, wherein a supporting surface of said lateral extension is coplanar with at least an edge portion of said second surface and one of said at least one protuberance and said at least one recess extends substantially perpendicular to said supporting surface of said lateral extension.

11. A three-dimensional object being formed from a plurality of separately interconnected pieces, each of said plurality of separate interconnected pieces comprising:

a main element having a first surface and an opposed second surface and a plurality of side surfaces, and each of said side surfaces extends substantially perpendicular to edge portions of said first and said second surfaces to facilitate abutment of two adjacent interconnected pieces with said side surfaces contacting one another;

said second surface having at least one lateral extension extending from said second surface of said main element along each of said plurality of side surfaces, each said lateral extension only extending a partial disetance along a length of said side surface, said at least one lateral extension being offset with respect to said second support surface and supporting a protuberance thereon;

at least one recess being formed in said second surface along each of said plurality of side surfaces and being spaced from said at least one lateral extension, said at least one recess extending only partially from said second surface toward said first surface and being shaped so as to releasibly mate with and lock a protuberance of another interconnectable piece; and said at least one lateral extension being rigidly attached to said main element.

12. The three dimensional object according to claim 1, wherein at least a portion of said first and second surfaces are curved surfaces.

* * * * *